US009481956B2

(12) United States Patent
Van Den Bergh et al.

(10) Patent No.: US 9,481,956 B2
(45) Date of Patent: Nov. 1, 2016

(54) PRETREATMENT CUP FOR TREATING DURABLE AND DELICATE FABRICS

(71) Applicant: The Procter & Gamble Company, Cincinnati, OH (US)

(72) Inventors: Pieter Paul Dirk Jenny Maria Van Den Bergh, Sint-Martens-Latem (BE); Annabelle Mayeux, Brussels (BE); Mohamed Samir, Geneva (CH); Wiliam John Davis, Bath (GB)

(73) Assignee: The Procter & Gamble Company, Cincinnati, OH (US)

( * ) Notice: Subject to any disclaimer, the term of this patent is extended or adjusted under 35 U.S.C. 154(b) by 112 days.

(21) Appl. No.: 14/220,176

(22) Filed: Mar. 20, 2014

(65) Prior Publication Data

US 2014/0304924 A1 Oct. 16, 2014

(30) Foreign Application Priority Data

Apr. 11, 2013 (EP) ..... 13163326

(51) Int. Cl.

| | |
|---|---|
| ***A47L 25/00*** | (2006.01) |
| ***D06F 3/04*** | (2006.01) |
| ***D06F 3/00*** | (2006.01) |

(52) U.S. Cl.

CPC . *D06F 3/04* (2013.01); *D06F 3/00* (2013.01); *A46B 2200/3053* (2013.01); *A47L 25/00* (2013.01)

(58) Field of Classification Search

CPC . A46B 2200/3053; A47L 25/00; D06F 3/00; D06F 3/04

USPC ..... 401/118, 126, 237, 371

See application file for complete search history.

(56) References Cited

U.S. PATENT DOCUMENTS

| | | | | |
|---|---|---|---|---|
| 4,767,034 | A | 8/1988 | Cramer | |
| 5,181,630 | A | 1/1993 | McNally | |
| 5,388,298 | A | 2/1995 | Rutter et al. | |
| 5,549,209 | A | 8/1996 | Weissman et al. | |
| 6,874,190 | B2 | 4/2005 | Deflander et al. | |
| 2003/0198502 | A1* | 10/2003 | Maloney | B65D 47/42 401/265 |
| 2011/0179585 | A1 | 7/2011 | Chawla et al. | |
| 2011/0311296 | A1* | 12/2011 | Chawla | A46B 9/028 401/137 |
| 2012/0297552 | A1 | 11/2012 | Davis et al. | |

FOREIGN PATENT DOCUMENTS

| | | |
|---|---|---|
| GB | 2 168 931 | 1/1989 |
| WO | WO2012/175986 A1 | 12/2012 |

OTHER PUBLICATIONS

EP Search Report, Application No. 13163326.5, dated Aug. 22, 2013, containing 6 pages.

* cited by examiner

*Primary Examiner* — Jennifer C Chiang
*Assistant Examiner* — Joshua Wiljanen
(74) *Attorney, Agent, or Firm* — Melissa G. Krasovec; Leonard W. Lewis; Steven W. Miller

(57) ABSTRACT

A pretreatment cup comprising elongated protrusions, having a length to width ratio of greater than 2, which are spaced so that the distance between the elongated protrusions is less than the height of the elongated protrusions, can be used for pretreating both durable and delicate fabrics.

14 Claims, 14 Drawing Sheets

PRETREATMENT CUP FOR TREATING DURABLE AND DELICATE FABRICS

FIELD OF THE INVENTION

Pretreatment cup, comprising elongated protrusions can provide improved pretreating of stains, on both durable and delicate fabrics.

BACKGROUND OF THE INVENTION

Liquid detergent compositions are most effective at removing stains from fabrics when they are directly applied to the stain, as part of a pretreatment regimen, even when the detergent composition is formulated to deliver superior removal of grease, soils, and other stains. Fabrics are typically produced by weaving or knitting textile fibres. In order to improve stain removal, the liquid detergent composition is preferably scrubbed into the stained fabric, so as to penetrate the stain, and release it from the fabric. Scrubbing is particularly useful for greasy stains, where the hydrophobic nature of the stain makes it more difficult for the liquid detergent composition to penetrate into the fabric. Insufficient penetration of the liquid detergent composition into the stained fabric can result in less than desired stain removal, particularly at low temperatures. This is because much of the stain removing actives remain on the surface, and are not able to work directly on the stain during pretreating.

Durable fabrics, such as jean material, corduroy, heavy cotton, and the like, comprise a tight weave pattern, strong fibres, thicker fabric material, and combinations thereof. As such, it is desirable to scrub hard, applying sufficient pressure to push the liquid detergent composition into the tight fibre weave, in between the fibres, and deep into the fabric material. In contrast, delicate fabrics, such as silk, rayon, and the like, typically comprise a more open weave pattern, comprise weaker fibres, a thinner fabric material, and combinations thereof. Therefore, less scrubbing is typically required for delicate fabrics, during pretreating. Indeed, excessive scrubbing of delicate fabrics will damage such fabrics. As a consequence, customers rarely use dosing devices for pretreating delicate fabrics, in order to avoid damaging the fabric.

Therefore, there is a need for a pretreatment device which enables sufficient pressure to be applied to effectively pretreat durable fabrics, while also being suitable for delicate fabrics, where less pressure should be applied, or the applied pressure should even be limited, so as not to damage the fabric.

U.S. Pat. No. 5,549,209 discloses a closure for a liquid laundry detergent container having an integrated brush, U.S. Pat. No. 5,388,298 discloses a dispenser with an integrated scrubbing surface and pretreat nozzle, U.S. Pat. No. 4,767,034 discloses a cup for a spray bottle, having an integrated scrubber. U.S. Pat. No. 6,874,190 discloses a hand-held container for washing laundry. U.S. Pat. No. 5,181,630 discloses a cup having a pouring spout. GB 2 168 931 discloses a cup having an applicator. WO2012/162040 (US2012297552 A1) discloses a pretreatment cup comprising a spreading region.

SUMMARY OF THE INVENTION

The present invention relates to pretreatment cup comprising: a base comprising an exterior base surface; a wall comprising an exterior wall surface; and an opening circumscribed by a rim, wherein the opening is at least partially opposite the base; wherein the exterior base surface is connected to the exterior wall surface at an exterior periphery surface; wherein a surface selected from the group consisting of: the exterior base surface, the exterior wall surface, the exterior periphery surface, and combinations thereof, comprises a scrubbing region, characterised in that the scrubbing region comprises at least two elongated protrusions, spaced apart by a distance between the elongated protrusions, the elongated protrusions having a length to width ratio of greater than 2, wherein the distance between the elongated protrusions is less than the height of the protrusions, at the position where the distance between the elongated protrusions is a minimum.

The present invention also relates to a method of laundering fabrics, comprising the steps of: applying a portion of a liquid detergent composition to the fabric, to form a treated portion of the fabric; scrubbing the treated portion of the fabric with the scrubbing region of the pretreatment cup; and washing the fabric in a laundry washing machine.

DETAILED DESCRIPTION OF THE INVENTION

Pretreatment cups having a scrubbing region, the scrubbing region comprising elongated protrusions having a length to width ratio of greater than 2, are particularly suited for pretreating a wide variety of fabrics. This is because the protrusions have a higher rigidity along the major axis of the protrusions, than in a direction perpendicular to the major axis of the protrusions. During pretreating, the scrubbing force is applied over a smaller cross section, when scrubbing in a direction parallel to the elongated protrusions, than when scrubbing in a direction perpendicular to the elongated protrusions. When the elongated protrusions have a distance between the protrusions which is less than the height of the elongated protrusions, even less abrasion may occur to the fabric, during scrubbing in the perpendicular direction, since the scrubbing force may be more uniformly applied to the fabric. In addition, the protrusions are more effective at smoothing out the fabric as the scrubbing force is applied in the perpendicular direction to the major axis of the elongated protrusions. As a result, less abrasion to the fabric may occur when scrubbing in a direction perpendicular to the elongated protrusions, making such a scrubbing motion particularly suitable for pretreating delicate fabrics.

When referring to a pretreatment cup, all percentages, ratios and proportions used herein are by weight percent of the pretreatment cup, unless otherwise specified. When referring to a liquid detergent composition, all percentages, ratios and proportions used herein are by weight percent of the liquid detergent composition, unless otherwise specified. The term "dose", unless indicated otherwise, is defined as a measured amount of liquid to be delivered from a container, cup, or other suitable device. Preferably, the dose is measured using the pretreatment cup.

The length along the major axis of an element of the pretreatment cup, for instance an elongated protrusion, is the length of the element in the longest direction of the element, as measured along the mid-point of the element. The width of the element, at a specified point along the major axis of an element, is the width as measured perpendicular to the major axis at the specified point along the major axis of the element. Where the position along the major axis is not defined, the width is deemed to be the maximum width, as measured perpendicular to the major axis, over the entire element. The height of an element is measured perpendicular to the surface to which the element is attached, at the specified point along the major axis of the element. Where the position along the major axis is not defined, the height is deemed to be the maximum height as measured perpendicular to the surface, over the entire element.

Figure 1:
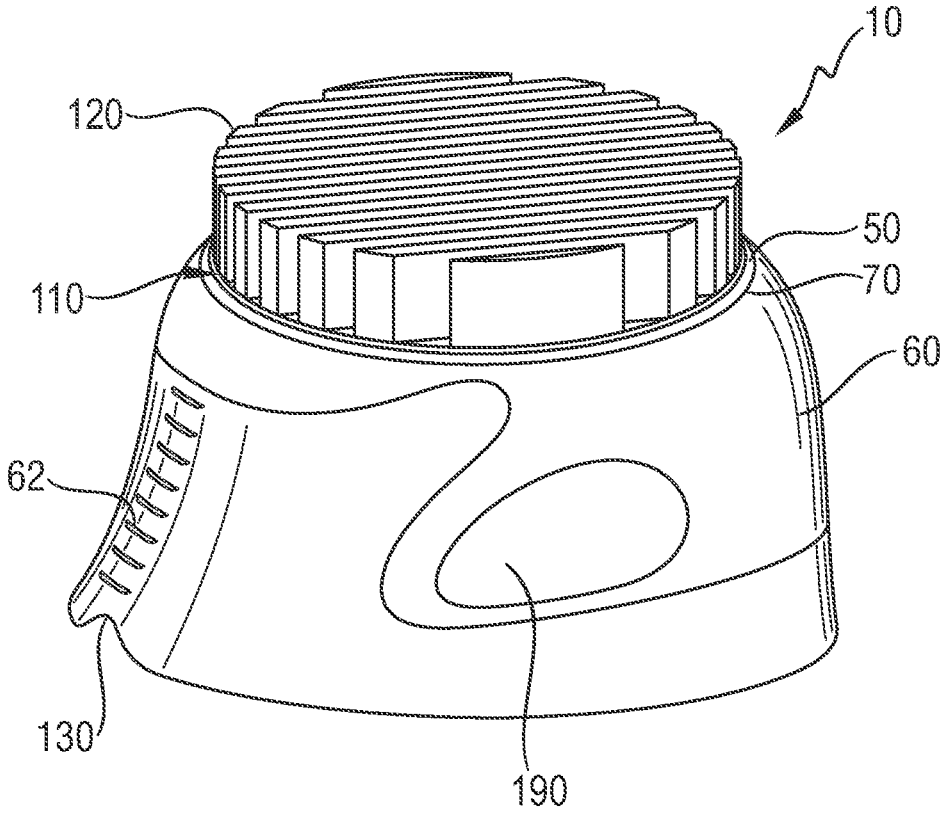
FIG. 1 illustrates an embodiment of the pretreatment cup (10), with the exterior base surface (50) oriented towards the top, comprising elongated protrusions (120), having a parallel orientation, on a scrubbing region (110), positioned on the exterior base surface (50).
Figure 2:
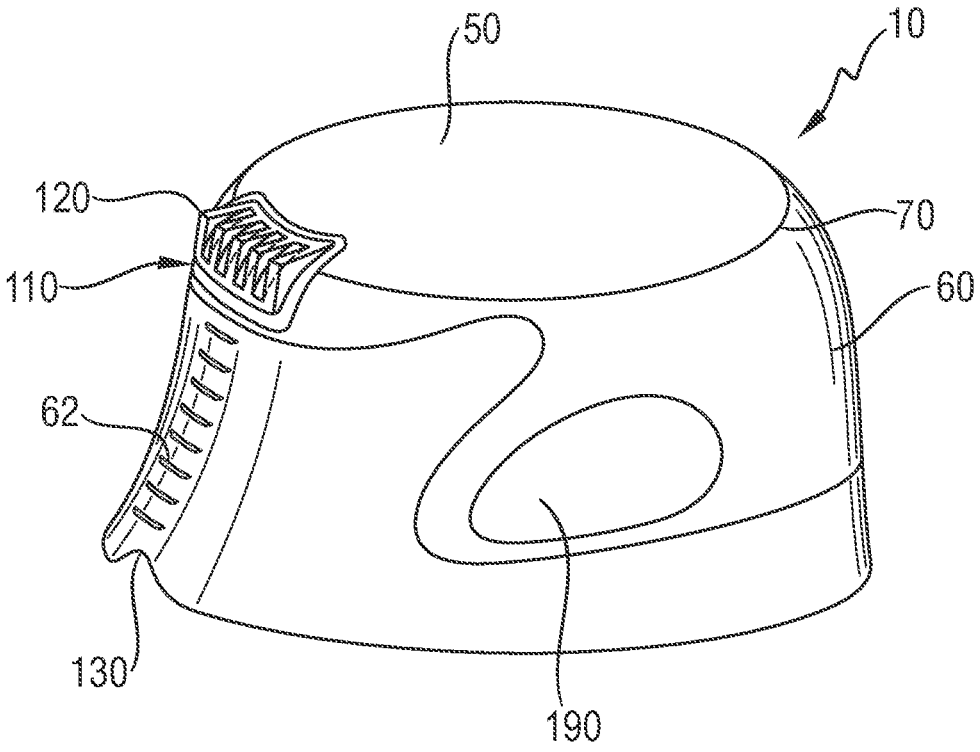
FIG. 2 illustrates an embodiment of the pretreatment cup (10), with the exterior base surface (50) oriented towards the top, comprising elongated protrusions (120), having a parallel orientation, on a scrubbing region (110), positioned at least partially on the exterior periphery surface (70).
Figure 3:
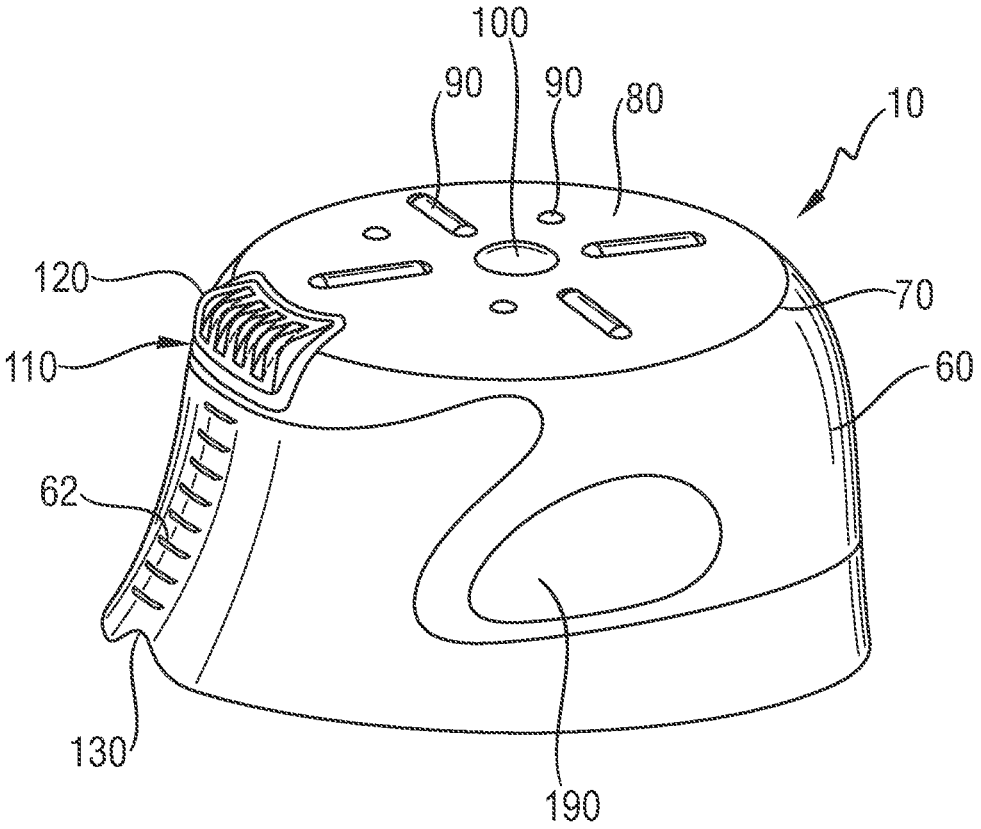
FIG. 3 illustrates an embodiment of the pretreatment cup (10), with the exterior base surface (50) oriented towards the top, comprising elongated protrusions (120), having a parallel orientation, on a scrubbing region (110), positioned at least partially on the exterior periphery surface (70), in addition to a spreading region (80) comprising spreading protrusions (90) in the form of dots, radiating from a central point (100), which is located at the centre of the spreading region (80).
Figure 4:
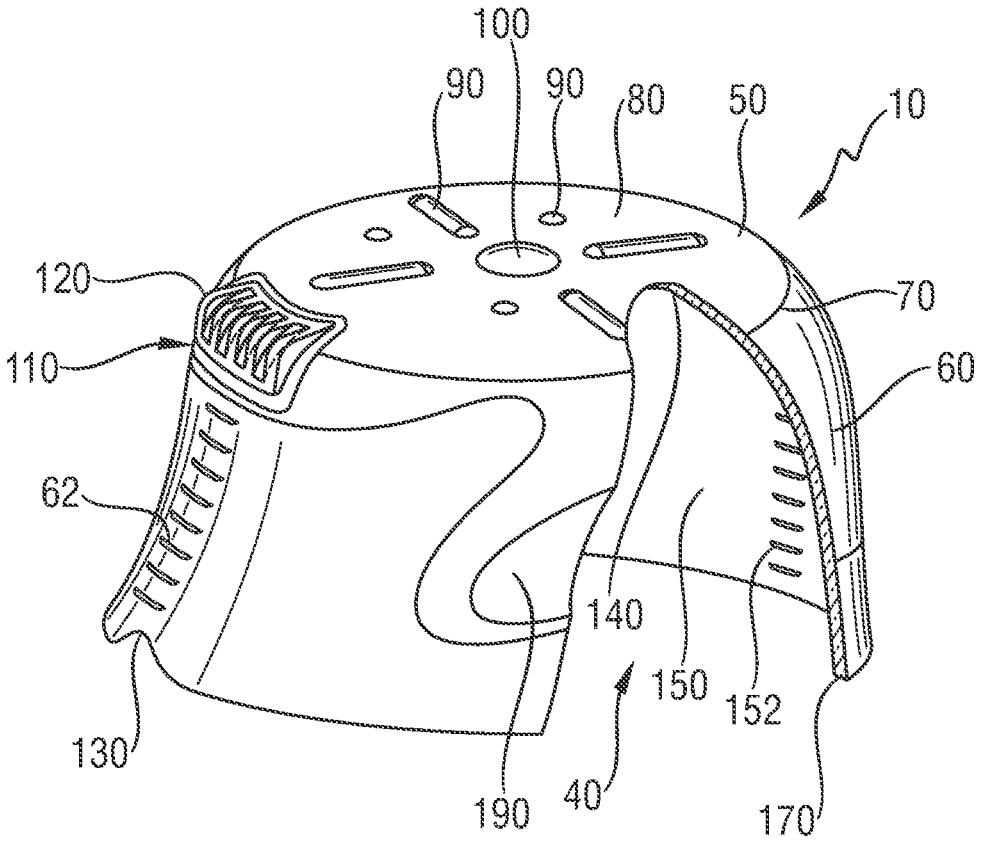
FIG. 4 illustrates the embodiment of FIG. 3, showing the interior of the pretreatment cup (10), comprising an interior base surface (140) and an interior wall surface (150), the interior wall surface (150) provided with one or more interior indicia (152). The opening (40) of the pretreatment cup (10) is circumscribed by a rim (170).
Figure 5:
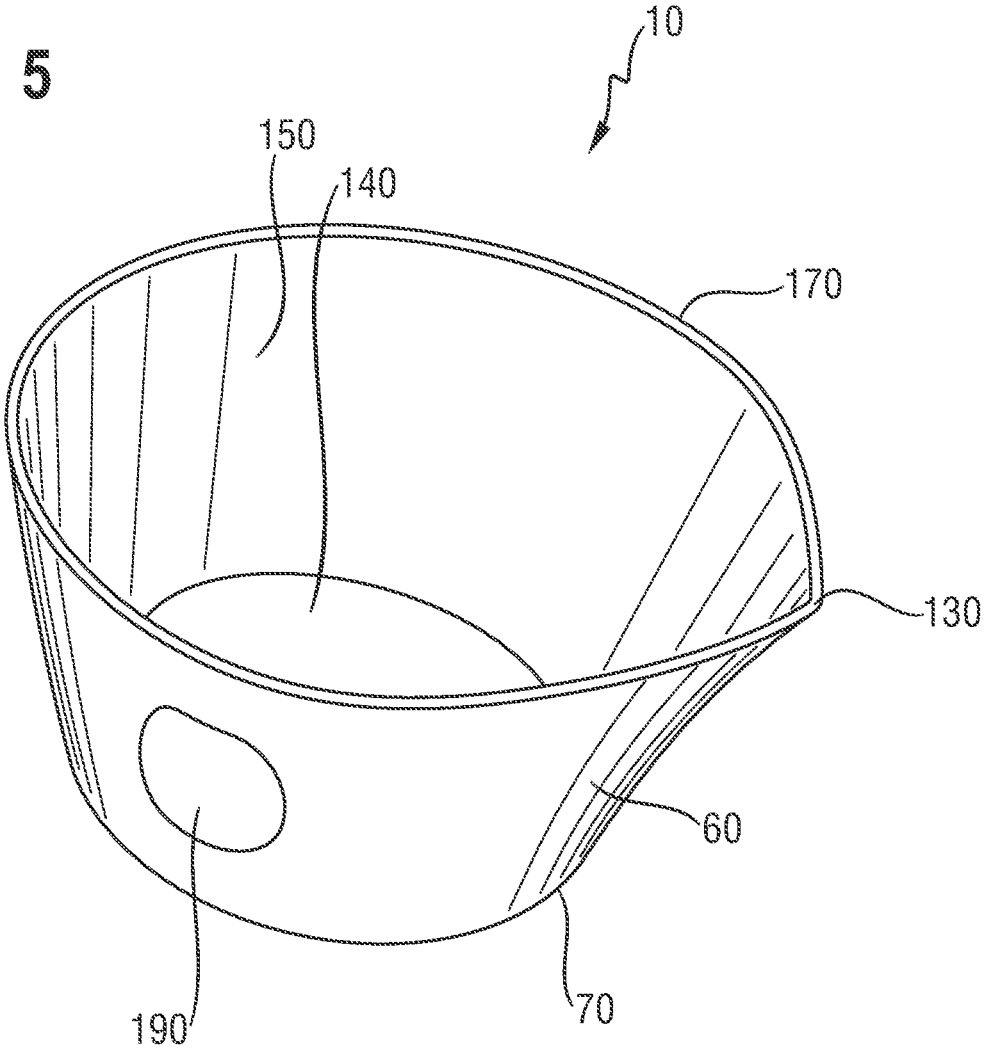
FIG. 5 illustrates an embodiment of the pretreatment cup (10), with the opening (40) oriented towards the top.
Figure 6A:
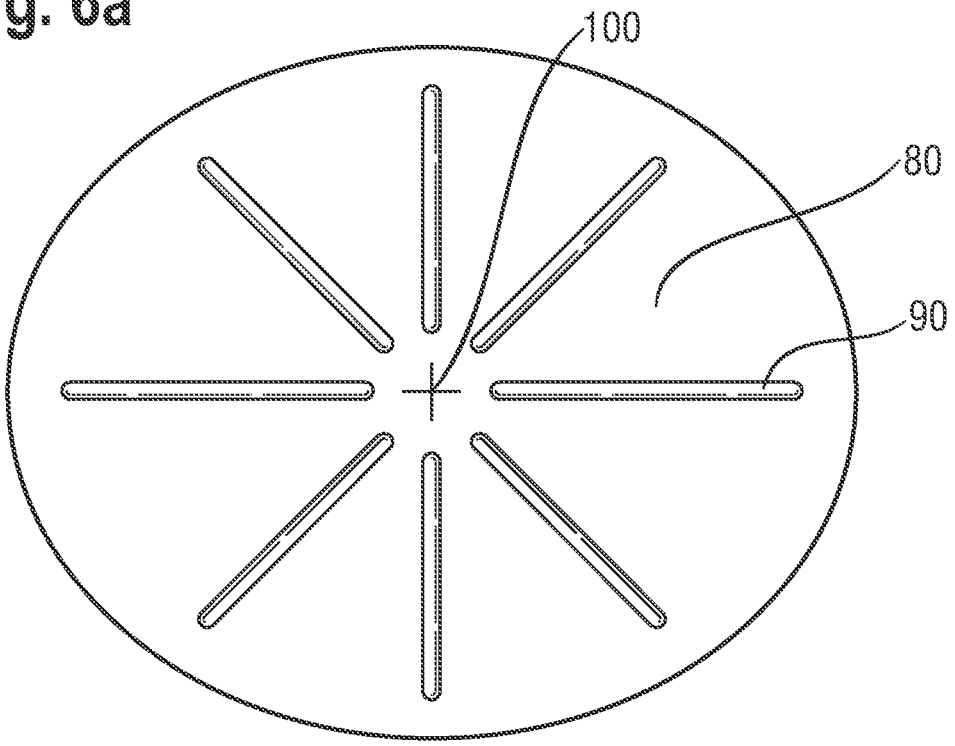
FIG. 6*a* illustrates a top view exemplifying a spreading region (80) comprising spreading protrusions (90) in the form of straight lines, radiating from a central point (100), which is located at the centre of the spreading region (80).
Figure 6B:
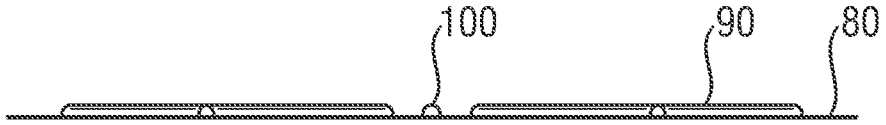
FIG. 6*b* illustrates a side view exemplifying the spreading region (80), of FIG. 3*a*.

The Pretreatment Cup:

The pretreatment cup (10) comprises a base, an exterior wall, and an opening (40) that is circumscribed by a rim (170). The opening (40) is at least partially opposite the base. The outer surface of the pretreatment cup is made up of an exterior base surface (50) connected to an exterior wall surface (60) at an exterior periphery surface (70). The pretreatment cup (10) may also comprise an interior base surface (140) and an interior wall surface (150), preferably at least partially connected together at an interior periphery. The pretreatment cup (10) also comprises a scrubbing region (120) and optionally a spreading region (110). Such a pretreatment cup is exemplified in FIG. 2 and FIG. 4.

The pretreatment cup (10) can be any suitable size. For stability, the base will typically have an area of from 300 $mm^2$ to 8,000 $mm^2$, preferably from 900 $mm^2$ to 5,600 $mm^2$, most preferably from 1,900 $mm^2$ to 3,800 $mm^2$. The width of the base will typically range from 20 mm to 100 mm, preferably 35 mm to 85 mm, most preferably from 50 mm to 70 mm. For easy filling, the opening (40) will typically have an area of from 700 $mm^2$ to 9,500 $mm^2$, preferably from 1,500 $mm^2$ to 7,000 $mm^2$, most preferably from 2,500 $mm^2$ to 5,000 $mm^2$. The width of the opening (40) will typically range from 30 mm to 110 mm, preferably 45 mm to 95 mm, most preferably from 60 mm to 80 mm. The wall will typically have a height of from 20 mm to 85 mm, preferably from 35 mm to 70 mm.

The exterior base surface (50) can be connected to the exterior wall surface (60) at the exterior periphery surface (70) at any angle, including 90°. Additionally, the exterior periphery surface (70) preferably comprises a curvature from the exterior base surface (50) to the exterior wall surface (60). Preferably, the radius of curvature at the exterior periphery surface (70) is from 2 mm to 35 mm, more preferably from 3.5 mm to 25 mm, most preferably from 5 mm to 15 mm. A curvature is particularly preferred if the pretreatment cup (10) comprises a scrubbing region (110) that is at least partially located at the exterior periphery surface (70).

The base, the wall, or both the base and the wall of the pretreatment cup (10) can be a single layer of material, such as high density polyethylene or polypropylene, a multilayered material, or any other material having sufficient structural integrity to be used as a pretreatment cup (10), and preferably also as a dosing device for dosing the liquid detergent composition into a washing machine. Preferably, the base, the wall, or both the base and the wall of the pretreatment cup (10) comprise polypropylene, for improved resistance to wear during pretreating and during wash cycles.

The exterior base surface (50) can provide a surface arrangement that can be stably set upon a substantially flat surface, such as a table or a flat portion of a washing machine or dryer. With such a configuration, when liquid detergent composition is poured into the pretreatment cup (10), the cup (10) will not easily tip over as detergent composition is poured into the pretreatment cup (10).

The pretreatment cup (10) can be provided with one or more indicia. The indicia are preferably located on a surface selected from the group consisting of: the interior wall surface (150), the exterior wall surface (60), and combinations thereof. Preferably, the interior wall surface (150) is provided with one or more interior indicia (152). It is particularly preferred that the exterior wall surface (60) is provided with one or more exterior indicia (62), when at least part of the wall is translucent or transparent. To facilitate easier measuring, both the interior wall surface (150) and exterior wall surface (60) can be provided with indicia. The indicia can be an etch, a depression, a raised portion, printing, or any other structure that is observable by the user.

The indicia can indicate the recommended dosage of liquid detergent composition to be poured into the pretreatment cup. Preferably, the indicia indicate the recommended dosages for a usage selected from the group consisting of: stain pretreating, average duty wash conditions, light duty wash conditions, heavy duty wash conditions, and mixtures thereof. Light duty wash conditions, typically consist of lightly soiled loads and low water hardness (from 50 mg/l to 125 mg/l of $CaCO_3$). Average duty wash conditions typically consist of moderately soiled loads and average water hardness (from 126 mg/l to 250 mg/l of $CaCO_3$). Heavy duty wash conditions typically consist of heavily soiled loads and high water hardness (greater than 250 mg/l of $CaCO_3$).

The pretreatment cup can also comprise a means for attachment to a liquid detergent composition container, preferably to the container cap. Suitable means include a clip, a screw thread, or a push-fit mechanism. In one embodiment, the interior base surface (140) of the pretreatment cup (10) comprises the first part of an attachment system, and the cap exterior top surface (310) of a cap (300), comprises a second part of an attachment system, wherein said attachment system comprises a cooperating attachment protrusion (200) and attachment channel (320). Alternatively, the pretreatment cap may also engage with a bottle to form a seal to close the container, hence forming a cap for the container.

The pretreatment cup may also comprise a spout (130), located on the rim (170). Preferably, the spout (130) is located vertically in line with the scrubbing region (110) to make it easier to pour a small amount of liquid detergent composition onto a stain and scrub with the scrubbing region (110), without the customer having to change his grip. Suitable spouts (130) include an outcrop from the rim (170) and wall, or may optionally comprise a hole in the wall, preferably close to the opening. The pretreatment cap (10) may include a baffle (180), adjacent to the spout (130). Such baffles (180) split the opening (40) into two or more sections comprising a fill opening (42) and a spout opening (44). The baffle (180) helps the customer to dose the required amount of liquid detergent composition onto the stain, without spilling excess liquid detergent composition.

The exterior wall surface (60) of the pretreatment cup (10) may also comprise a gripping region (190). The gripping region (190) may be selected from: an indented region, a raised region, a textured region, or a combination thereof. The gripping region (190) guides the customer to hold the pretreatment cup (10) is such a manner, that pouring the liquid detergent composition, optionally spreading the liquid detergent composition, scrubbing with the liquid detergent composition, and combinations thereof, become intuitive for the customer. The scrubbing region (110) is preferably positioned on a surface, in between two gripping regions (190).

Figure 14A:
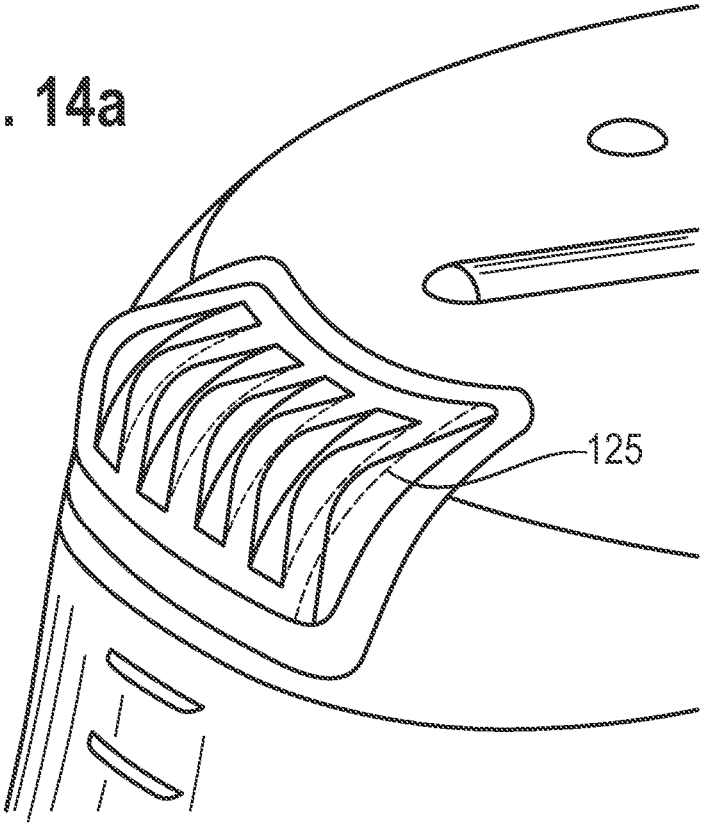
FIG. 14*a* illustrates part of the embodiment of FIG. 3, showing the length (125) of the elongated protrusion (120), measured as the axial length, along the major axis of the protrusions, on the surface which comprises the elongated protrusion (120). The height of the elongated protrusion (120) is measured perpendicular to the surface, from the length (125). The width is measured perpendicular to the length (125), on the surface which comprises the elongated protrusion (120).
Figure 14B:
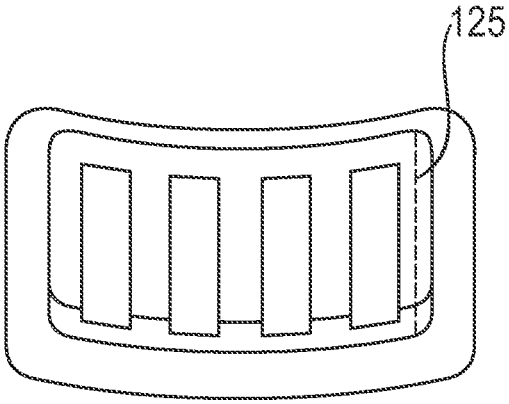
FIG. 14*b* illustrates a top view of FIG. 14*a*.

Scrubbing Region:

The pretreatment cup (10) comprises a scrubbing region (110). The scrubbing region (110) comprises at least two elongated protrusions (120), the elongated protrusions having a length to width ratio of greater than 2, wherein the distance between the elongated protrusions is less than the height of the protrusions, at the position where the distance between the elongated protrusions is a minimum. The scrubbing region (110) preferably comprises from 2 to 50, more preferably 5 to 30, even more preferably 10 to 20 elongated protrusions (120).

Where the distance between the elongated protrusions is a minimum over a length of the elongated protrusions (120), such as in the case where the elongated protrusions are parallel to each other, the relevant height is the maximum height where the distance between the elongated protrusions (120) is a minimum. The length of the elongated protrusion is measured as the axial length, along the major axis of the protrusions, on the surface which comprises the elongated protrusion (120) (see FIGS. 14*a* and 14*b*). The height of the elongated protrusion (120) is measured perpendicular to the surface which comprises the elongated protrusion (120). The width is measured perpendicular to the axial length. Preferably, the elongated protrusions having a length to width ratio of greater than 4, more preferably greater than 5, even more preferably greater than 10.

During pretreatment, a liquid detergent composition is applied to the stain, before scrubbing with the scrubbing region (110) of the pretreatment cup (10). When a fabric is pretreated by scrubbing in a direction which is substantially parallel to the major axis of the elongated protrusions (120), the scrubbing force is applied over the width of the elongated protrusions (120). In contrast, when the fabric is pretreated by scrubbing in a direction which is substantially perpendicular to the major axis of the elongated protrusions (120), the scrubbing force is applied over the length of the elongated protrusions (120). As a result, greater pressure is applied when scrubbing in a direction which is substantially parallel to the major axis of the elongated protrusions (120), in comparison to scrubbing in a direction which is substantially perpendicular to the major axis of the elongated protrusions (120).

When scrubbing in a direction that is substantially parallel to the major axis of the elongated protrusions, the scrubbing motion is typically at an angle of less than 40°, more typically less than 30°, even more typically less than 15° to the major axis of the elongated protrusions. When scrubbing in a direction that is substantially perpendicular to the major axis of the elongated protrusions, the scrubbing motion is typically at an angle of more than 50°, more typically more than 60°, even more typically more than 75° to the major axis of the elongated protrusions.

The distance between the elongated protrusions (120) is less than the height of the protrusions, at the position where the distance between the elongated protrusions (120) is a minimum. As a result, when an elongated protrusion (120) folds under an force applied perpendicular to the major axis of the elongated protrusion (120), at least part of the elongated protrusion (120) contacts an adjacent protrusion (120).

While the elongated protrusions (120) can have any orientation, the elongated protrusions preferably have a substantially parallel orientation. Such elongated protrusions (120) typically have a distance between the elongated protrusions (120) which varies by less than 100%, preferably less than 50%, more preferably less than 25%, even more preferably less than 15% over the length of the elongated protrusions (120), as measured on the surface of the scrubbing region (100).

The elongated protrusions (120) are preferably flexible, such that they are able to bend when a force is applied in a direction perpendicular to the axial length of the elongated protrusions (120). Such flexible elongated protrusions (120) limit the scrubbing force that is applied to the fabric, when scrubbing in a direction which is substantially perpendicular to the major axis of the elongated protrusions (120), since they buckle when the applied force is too great. As a result, such flexible elongated protrusions (120) limit or even prevent damage to delicate fabrics during pretreatment.

As such, the elongated protrusions preferably have a Shore Hardness A of from 1 to 100, preferably 25 to 75, more preferably 30 to 50, as measured using DIN53505. The elongated protrusions can be made from a material selected from the group consisting of: elastomers, rubbers, and mixtures thereof. The elongated protrusions are preferably made from elastomers. While both thermoset elastomers and thermoplastic elastomers can be used, thermoplastic elastomers are preferred since they are easier to form into elongated protrusions (120).

Elastomers are polymers with viscoelasticity, generally having low Young's modulus and high yield strain compared with other materials. Elastomers are amorphous polymers existing above their glass transition temperature, so that considerable segmental motion is possible. As such, they are relatively soft and deformable at ambient temperatures, for instance 21° C.

Thermoplastic elastomers (TPE) are copolymers or a physical mix of polymers, such as a plastic and a rubber, which comprises materials with both thermoplastic and elastomeric properties. Thermoplastics are relatively easy to use in manufacturing, for example, by injection moulding. Thermoplastic elastomers show advantages typical of both rubbery materials and plastic materials. The principal difference between thermoset elastomers and thermoplastic elastomers is the type of crosslinking bond in their structures. The crosslink in thermoset polymers is a covalent bond created during a vulcanization process. In contrast, the crosslink in thermoplastic elastomer polymers is reversible, typically a weaker dipole or hydrogen bond or a difference in material phase. Examples of suitable thermoplastic elastomers, methods of making them, and methods of processing that, can be found in "Handbook of Thermoplastic Elastomers", December 2007, Drobny, ISBN 9780815515494.

Suitable rubbers can be either naturally derived, or synthetically derived. Naturally derived rubber comprises suitable polymers derived from natural sources, most often isoprene with minor impurities of other organic compounds. Natural rubber is typically harvested in the form of latex. The latex is then refined into rubber ready for commercial processing. Synthetically derived rubber is an artificial elastomer, derived from petroleum by-products, which is crosslinked via vulcanisation. Rubber can be used either alone or in combination with other materials.

The elongated protrusions (120) preferably have a maximum height which is greater than the maximum width. More preferably, the maximum height is at least two times the maximum width. Even more preferably, the maximum height is at least four times the maximum width. The elongated protrusions (120) preferably have a maximum height of from 0.2 mm to 25 mm, more preferably from 0.5 mm to 10 mm, most preferably from 1 mm to 5 mm. The elongated protrusions (120) preferably have a maximum width of from 0.1 mm to 10 mm, preferably from 0.2 mm to 5 mm, more preferably from 0.5 m to 2 mm. When the elongated protrusions have the aforementioned maximum height, maximum width, and combinations thereof, they provide improved rigidity when scrubbing in the lengthwise direction, relative to the elongated protrusions (120), while being sufficiently flexible to deform when the scrubbing direction is perpendicular to the elongated protrusions (120).

The elongated protrusions (120) are preferably separated by a distance of from 0.1 to 25 mm, more preferably 0.2 mm to 10 mm, most preferably 0.5 mm to 1.5 mm, where the distance between the elongated protrusions is a minimum. With the aforementioned separation, the elongated protrusions (120) can lie on top of each other when scrubbing in a direction perpendicular to the major axis of the elongated protrusion (120). As such, they provide a flatter, more deformable surface when scrubbing delicate fabrics.

The elongated protrusions (120) can have any suitable axial length, depending on the shape of the pretreatment cup, and also where on the pretreatment cup (10) the scrubbing region (110) is positioned. Preferably, the length of the elongated protrusions is greater than 3 mm. The maximum length of the elongated protrusions can be any length suited, but is limited by the space available at the desired location of the scrubbing region on the cup.

The scrubbing region (80) is preferably at least partially located on the exterior periphery surface (70), since many customers prefer to use the exterior periphery surface (70) to apply greater pressure while scrubbing, and also find such positioning to be more ergonometric.

Spreading Region:

The pretreatment cup may comprise a spreading region (80) located on a surface selected from the group consisting of: the exterior base surface (50), the exterior wall surface (60), and mixtures thereof. For ease of handling, the spreading region (80), if present, is preferably at least partially located on the exterior base surface (50). Preferably, the spreading region (80), if present, is located on the exterior base surface (50). The spreading region may be any suitable shape, though circular and oval shapes are preferred. While the spreading region may be flat, with the exception of the spreading protrusions (90), a small curvature is preferred for spreading the liquid detergent composition over the stained part of the fabric. In addition, a small curvature helps to smooth out the fabric and remove folds during pretreating. However, it is preferable that the curvature is not so great that the spreading wipes the liquid laundry detergent composition thinly or unevenly over the stained region of the fabric. Preferably, the spreading region (80) has a curvature such that when the pretreatment cup is positioned with the centre of mass of the spreading region (80) on a flat non-deformable surface (such as a table), the pretreatment cup can be tilted a maximum of 45°, preferably a maximum of 30°, more preferably a maximum of 15°before the spreading region is no longer in contact with the non-deformable surface. Preferably, the spreading region (80) has no sharp changes in curvature (such as a step). The centre of mass of the spreading region is calculated using the formula (ρ is the density in $Kg/m^3$, and V is the material volume in $m^3$):

$$R = \frac{\int \rho(r) r dV}{\int \rho(r) dV} \tag{1}$$

Figure 7:
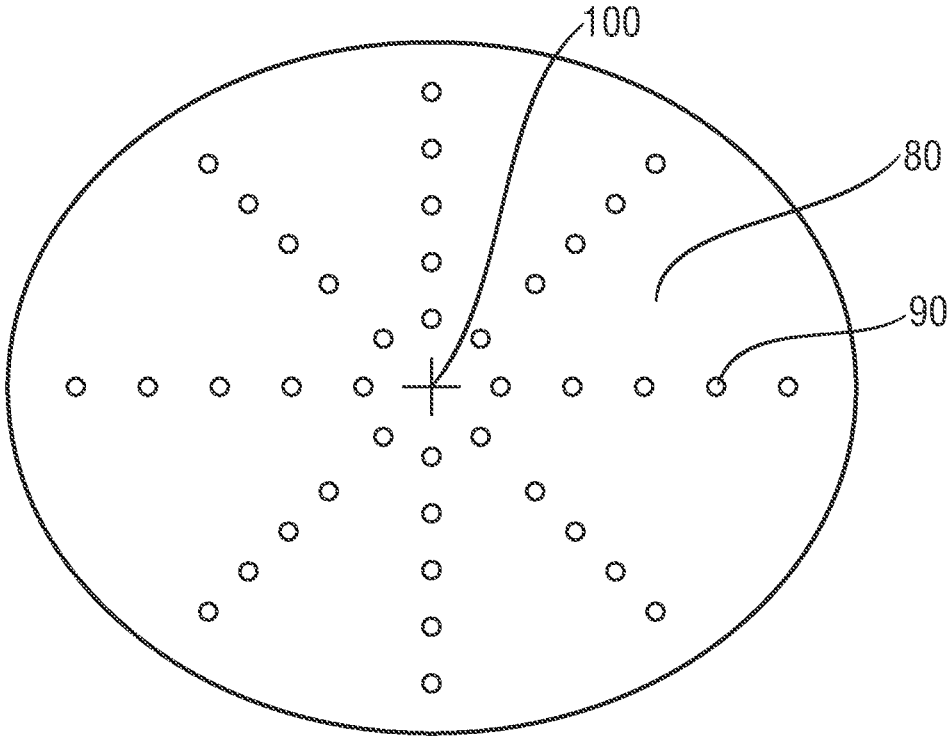
FIG. 7 illustrates a top view exemplifying a spreading region (80) comprising spreading protrusions (90) in the form of dots, radiating from a central point (100), which is located at the centre of the spreading region (80).
Figure 8:
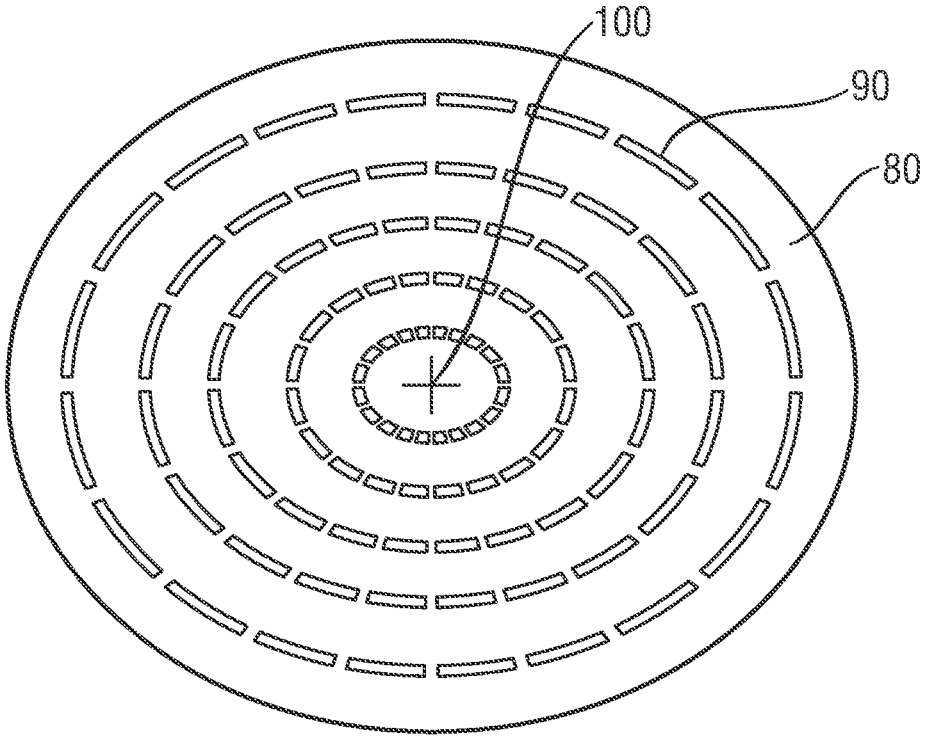
FIG. 8 illustrates a top view exemplifying a spreading region (80) comprising spreading protrusions (90) in the form of straight lines, oriented concentrically around a central point (100), which is located at the centre of the spreading region (80).
Figure 9:
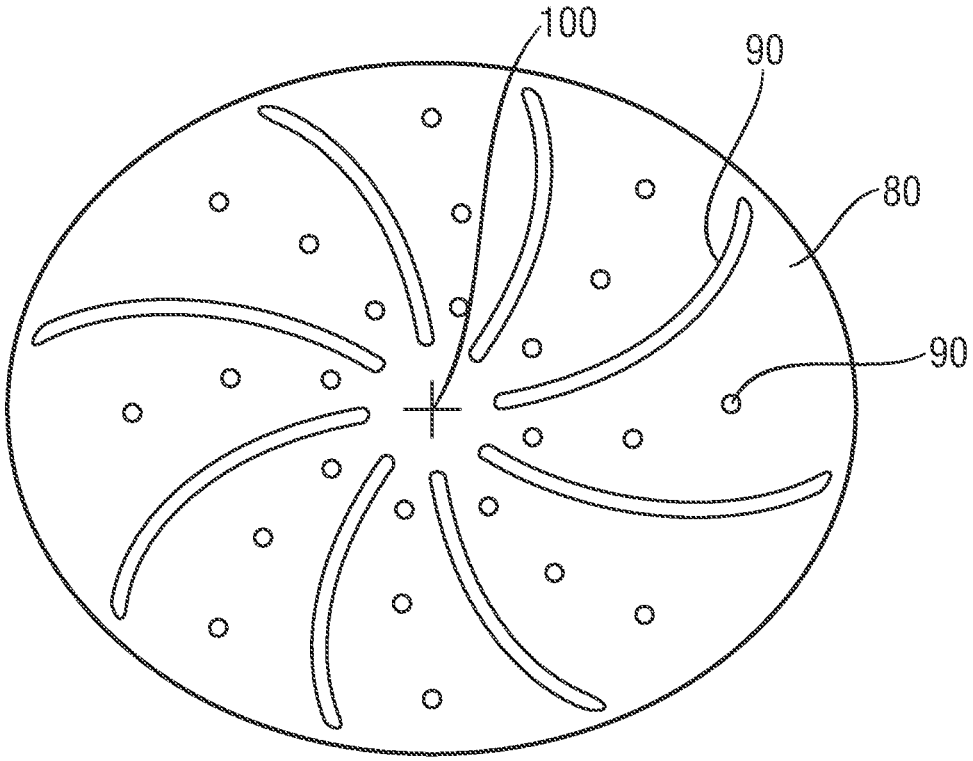
FIG. 9 illustrates a top view exemplifying a spreading region (80) comprising spreading protrusions (90) in the form of curved lines and dots, oriented spirally around a central point (100), which is located at the centre of the spreading region (80).
Figure 10:
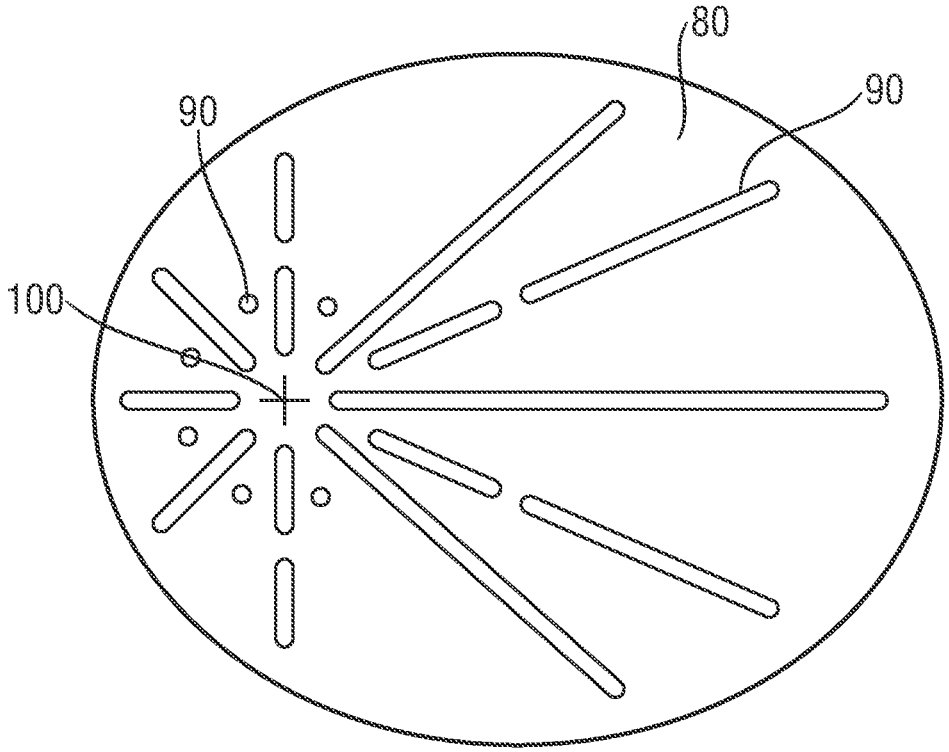
FIG. 10 illustrates a top view exemplifying a spreading region (80) comprising spreading protrusions (90) in the form of straight lines and dots, oriented radially around a central point (100), which is located to the left of centre of the spreading region (80).
Figure 11:
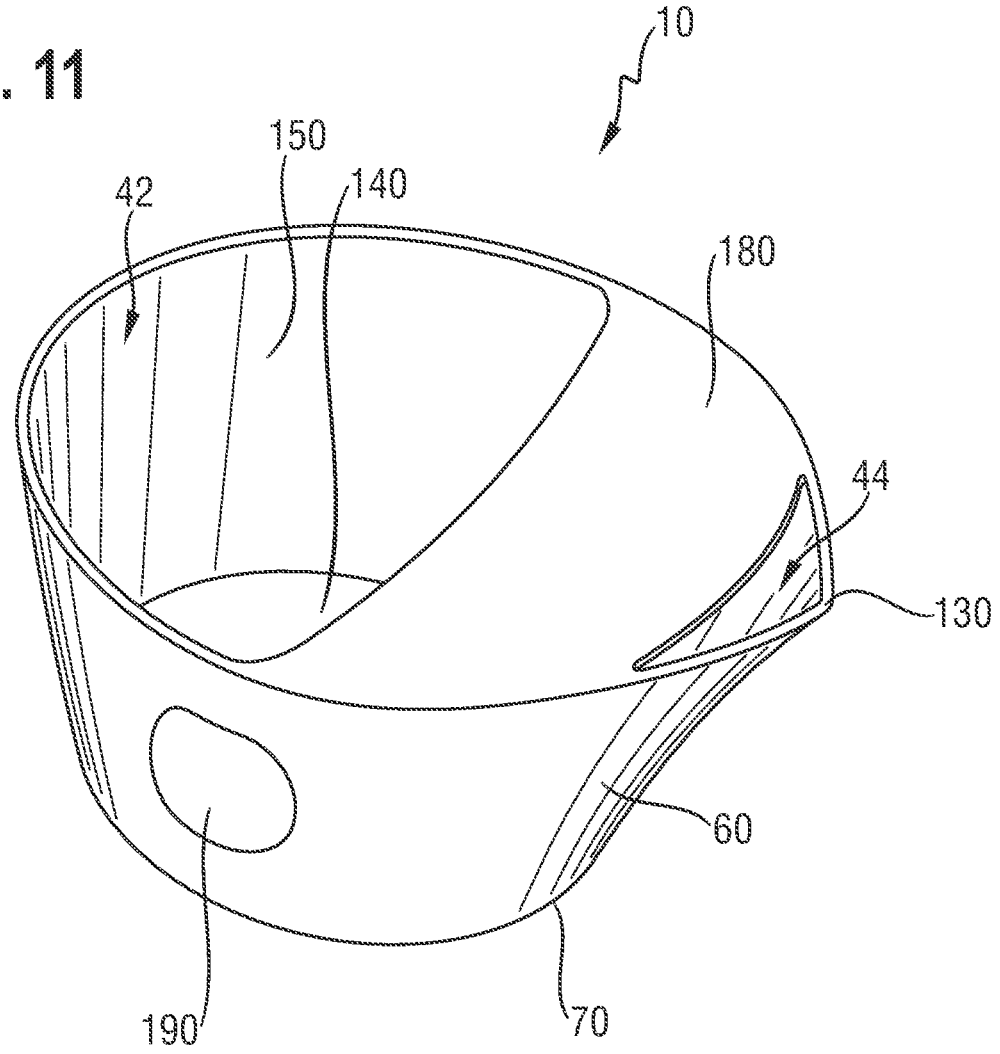
FIG. 11 illustrates an embodiment of the pretreatment cup (10), with the exterior base surface (50) oriented at the top, further comprising a baffle (180) which divides the opening into a fill opening (42) and a spout opening (44).
Figure 12:
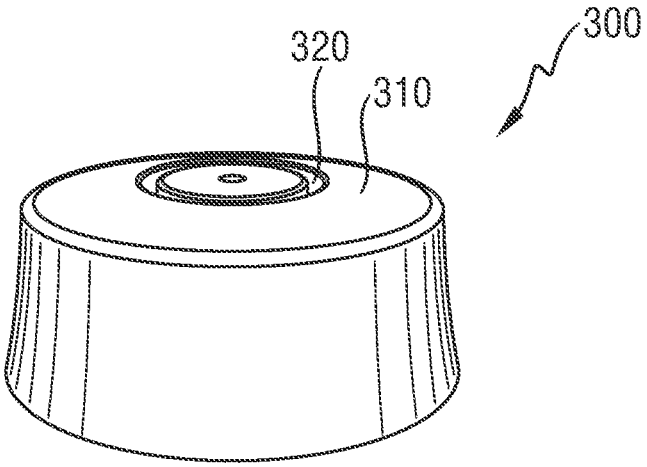
FIG. 12 illustrates a container cup (300) comprising a circular attachment channel (320) on the cup exterior top surface (310).
Figure 13:
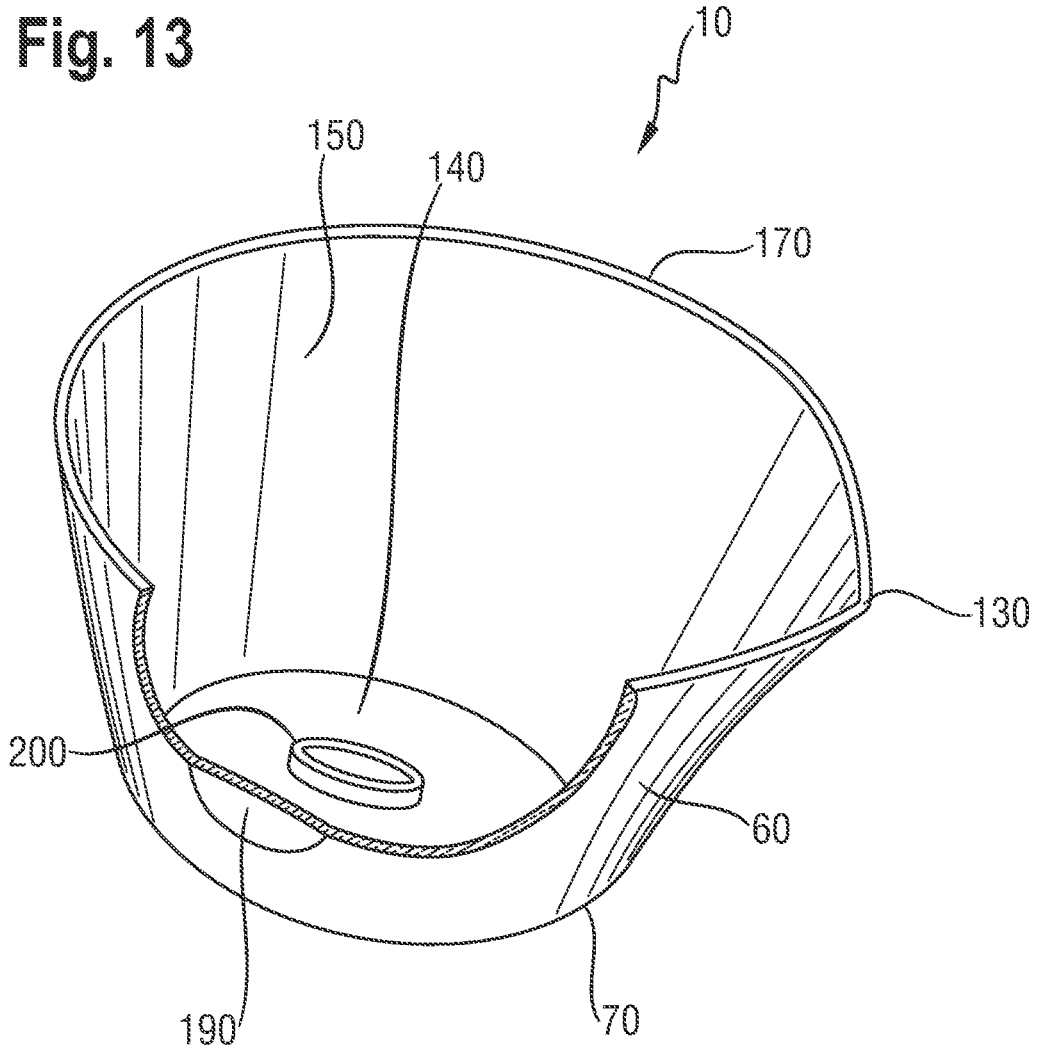
FIG. 13 illustrates an embodiment of a pretreatment cup (10), with the exterior base surface (50) oriented at the top, further comprising a ring-shaped attachment protrusion (200).

The spreading region (80) comprises 1 or more spreading protrusions (90). Preferably, the spreading region (80) comprises at least 25, more preferably at least 50, most preferably at least 75 spreading protrusions (90). The spreading region (80) can comprise any number of spreading protrusions (90), though less than 200, preferably less than 150, more preferably less than 120 are preferred. The spreading protrusions (90) are preferably selected from the group consisting: of lines, dots, and mixtures thereof. If lines are present, they can be straight or curved. They can be from 2 mm to 40 mm, preferably from 3 mm to 25 mm, more preferably from 4 mm to 5 mm in length. The width of the lines can be from 0.2 mm to 4 mm, preferably from 0.5 mm to 3 mm, more preferably from 0.8 mm to 2 mm in width. The lengths are measured along the axial length of the line. If dots are present, they can be any shape, but are preferably circular or oval in shape. The dots can have a width of from 0.2 mm to 5 mm, preferably from 0.5 mm to 4 mm, more preferably from 1 mm to 3 mm. Such spreading protrusions (90) do not result in the liquid laundry detergent composition being restricted under the spreading region, when the pretreatment cup is used for spreading the liquid detergent composition over a stain. Suitable lines are exemplified in FIGS. 6, 8, 9, and 10. Suitable dots are exemplified in FIGS. 7, 9, and 10.

The spreading protrusions (90) can be arranged in a pattern selected from the group consisting of: radial, concentric, spiral, or mixtures thereof. A concentric pattern is preferred. While the central point (100) of the pattern is preferably located at the centre of mass of the spreading region (80), the central point (100) of the pattern can be located at any suitable point on the spreading region (80). The resultant distribution of spreading protrusions (90) helps to distribute the liquid detergent composition uniformly over the stain.

For ease of manufacture, the spreading region, preferably including the spreading protrusions (90), can be made from one material. Preferably, the material comprises polypropylene. More preferably, the spreading region is made from polypropylene. However, in other embodiments, the spreading protrusions (90) can be made from a different material from the rest of the spreading region (80).

If the spreading protrusions (90) are too flexible, flicking of the liquid detergent composition may occur during use. Therefore, the spreading protrusions (90) are preferably made from a material having a hardness, as measured on the Rockwell scale (ISO 2039-2), of from 50 to 150. The spreading protrusions (90) are made from a material having a hardness that is more preferably from 60 to 100, and most preferably from 65 to 85, as measured on the Rockwell scale (ISO 2039-2). For a similar reason, it is preferred that the spreading protrusions (90) have a height from the exterior base surface (50) of from 0.2 mm to 4 mm, preferably from 0.5 mm to 1.5 mm In addition, such patterns smooth out and deform the fibrous structure of the fabric being treated, and help spread the liquid detergent composition uniformly over the stain.

To avoid the scrubbing region (110) affecting spreading of the liquid detergent composition by the spreading region (80), the spreading region (80), if present, is preferably located at least partially on a different plane to the scrubbing region (110). In a more preferred embodiment, the scrubbing region (110) is located at least partially on the exterior wall surface (60), the exterior periphery surface, and combinations thereof, while the spreading region (80) is located at least partially on the exterior base surface (50). In another embodiment, both the spreading region (80) and the scrubbing region (110) are located on the exterior base surface (50), with the exterior base surface (50) curved such that the scrubbing region (110) is located on a different plane to the spreading region (80). In yet another embodiment, the exterior base surface (50) is divided into two connected surfaces which are angled relative to each other, with the scrubbing region (110) located onto one surface, and the spreading region (80) located onto the other surface, such that the two regions are located on different planes.

To simplify use, and for easy of manufacture, the spreading region (80) and scrubbing region (110) may be connected together. In a preferred embodiment, the spreading region (80) and scrubbing region (110) may contact each other at the exterior periphery surface (70).

Differentiation of the Pretreating Regions:

It has been surprisingly discovered that emphasizing the pretreatment benefits of the pretreatment cup (10) encourages the customer to use the pretreatment cup (10) for pretreating fabric stains. Therefore, it is preferred that a pretreating region selected from: the spreading region (80), the scrubbing region (120), and combinations thereof, is differentiated from at least part of the remaining combined area of the exterior base surface (50), the exterior wall surface (60), the exterior periphery surface (70), and combinations thereof, by a difference in: material, colour, translucency, surface texture, a line, and mixtures thereof. More preferably, the pretreating region is differentiated from at least part of the remaining combined area of the exterior base surface (50), the exterior wall surface (60), the exterior periphery surface (70), and combinations thereof, by a difference in: material, colour, translucency, a line, and mixtures thereof. Most preferably, the pretreating region is differentiated from at least part of the remaining combined area of the exterior base surface (50), the exterior wall surface (60), the exterior periphery surface (70), and combinations thereof, by a difference in: colour, translucency, and mixtures thereof.

For greater emphasis, the pretreating region can be differentiated from at least part of the remaining combined area of the exterior base surface (50), the exterior wall surface (60), the exterior periphery surface (70), and combinations thereof, by at least two differences selected from differences in: material, colour, translucency, surface texture, a line, and mixtures thereof.

Preferably, the pretreating region is differentiated from at least 25%, preferably 50%, more preferably 75% of the remaining combined area of the exterior base surface (50), the exterior wall surface (60), the exterior periphery surface (70).

It is believed that such differentiation helps to guide the customer to intuitively select the correct surface for use in pretreating. Surprisingly, the effect is greater when at least part of the pretreatment cup is opaque. In particular, when at least part of a pretreating region selected from the group consisting of: a spreading region (80), a scrubbing region (110), and combinations thereof, is opaque. Preferably, at least part of the exterior base surface (50), the exterior wall surface (60), the exterior periphery surface (70), and combinations thereof, excluding the scrubbing region (110) and spreading region (80), if present, is transparent. More preferably, at least 50% of the exterior base surface (50), the exterior wall surface (60), the exterior periphery surface (70), and combinations thereof, excluding the scrubbing region (110) and spreading region (80), if present, is transparent. A material is defined as "opaque" when the material has a measured translucency of less than 30%, preferably less than 20%, more preferably less than 10% (using the method enclosed herein for measuring transparency/translucency). A material is defined as "transparent" when the material has a measured translucency of greater than 50%, preferably greater than 60%, more preferably greater than 70%, most preferably greater than 80%, using the method described herein.

For similar reasons, if both a spreading region (80) and a scrubbing region (110) are present, the spreading region (80) can be differentiated from the scrubbing region (110) by: a difference in material, a difference in colour, a difference in translucency, a difference in surface texture, a line, and combinations thereof. The elongated protrusions (120) of the scrubbing region (110) typically also have a different pattern from that of the spreading protrusions (90) of the spreading region (80). The elongated protrusions (120) are preferably oriented differently from the spreading protrusions (90), or are a different shape, or have both a different orientation and a different shape. It is also believed that such a pretreatment cup leads to an increased perception by the customer that the liquid detergent composition and the pretreatment cup are effective together for pretreating stains, even hydrophobic stains such as grease. While the elongated protrusions (120) and the spreading protrusions (90) can be made from the same material, they are preferably made from different materials, for example, having different hardness. In such embodiments, the elongated protrusions (120) can be made from a more deformable material than the spreading protrusions (90).

Liquid Detergent Composition:

Liquid detergent compositions, as described herein, include flowable liquid detergent compositions for treating fabrics. Such compositions are often referred to as liquid laundry detergent compositions. As used herein, "liquid laundry detergent composition" refers to any laundry treatment composition comprising a fluid capable of wetting and cleaning fabric e.g., clothing, in a domestic washing machine. The liquid detergent composition can include solids or gases in suitably subdivided form, but the overall composition excludes product forms which are non-fluid overall, such as tablets or granules.

For improved pretreatment benefit, the liquid laundry detergent composition comprises a soil removal ingredient, selected from the group consisting of: a surfactant system; an enzyme; a soil release or soil suspension polymer; and mixtures thereof.

Liquid laundry detergent compositions for use in pretreating typically comprise from 1% to 70%, preferably from 5% to 60%, more preferably from 10% to 50%, and most preferably from 15% to 45% by weight of a surfactant selected from the group consisting of: anionic, nonionic surfactants and mixtures thereof. The preferred ratio of anionic to nonionic surfactant is from 100:0 (i.e. no nonionic surfactant) to 5:95, more preferably from 99:1 to 1:4, most preferably 5:1 to 1.5:1.

The liquid laundry detergent composition preferably comprises from 1 to 50%, more preferably from 5 to 40%, most preferably from 10 to 30% by weight of one or more anionic surfactants. For improved grease removal, levels of up to 30%, more preferably from 1 to 15%, most preferably from 2 to 10% by weight of one or more nonionic surfactants is preferred.

Surfactant systems having a high HIc of from 8.0 to 9.2, preferably from 8.2 to 9.1, more preferably from 8.4 to 9.0, are better able to lift and disperse stains, particularly greasy stains. Preferably, such surfactant systems comprise surfactants selected from the group consisting of: non-soap anionic, nonionic, amphoteric, amine, poly hydroxyl fatty acid amines, and mixtures thereof. Particularly preferred are anionic surfactants, nonionic surfactants, and mixtures thereof.

The relative hydrophilicity of a surfactant system is given by the Hydrophilic Index (HIc), as detailed in WO 00/27958:

$$HIc=\Sigma_y(\text{weight \% of surfactant } y \text{ in the surfactant system})\times HI_{sy},$$

wherein HIsy is calculated for each of the surfactants as follows:

$$HIsy = 20 \times \frac{(\text{the molecular weight of the hydrophilic portion of surfactant component } y)}{(\text{the molecular weight of the surfactant component } y)}$$

For the purposes of calculating the Hydrophilic Index, fatty acids are not considered as surfactants. Fatty acids are, however, preferred for use in liquid laundry detergent compositions in combination with the pretreatment cup of the present invention. Especially preferred is rapeseed fatty acid. Other suitable fatty acids include saturated and/or unsaturated fatty acids obtained from natural sources or synthetically prepared. Examples of suitable fatty acids include capric, lauric, myristic, palmitic, stearic, arachidic, and behenic acid. Other suitable fatty acids include palmitoleic, oleic, linoleic, and ricinoleic acid. The fatty acid is preferably present at a level of from 2% to 15% by weight of the liquid laundry detergent composition.

The surfactant systems of the present invention preferably comprise linear alkyl benzene sulphonates and may also comprise other anionic surfactants such as, alkyl sulphates, alkyl polyethoxylate sulphates and mixtures thereof. The detergent compositions of the present invention may contain other non-soap anionic surfactants. Generally speaking, anionic surfactants useful herein are disclosed in U.S. Pat. Nos. 4,285,841, 3,919,678, and WO 00/27958.

Suitable nonionic surfactants are disclosed in U.S. Pat. Nos. 3,929,678, 4,285,841, and WO 00/27958. Exemplary, non-limiting classes of useful nonionic surfactants include: C8-C18 alkyl ethoxylates ("AE"), with EO 1-22, including the so-called narrow peaked alkyl ethoxylates and C6-C12 alkyl phenol alkoxylates (especially ethoxylates and mixed ethoxy/propoxy), alkyl dialkyl amine oxides, alkanoyl glucose amides, and mixtures thereof.

The liquid detergent compositions of the present invention may comprise from 0.0001% to 8% by weight of a detersive enzyme which provides cleaning performance. Suitable enzymes include proteases, amylases, lipases, xyloglucanases, pectate lypases, mannanases, bleaching enzymes, cutinases, and mixtures thereof. A preferred enzyme combination comprises a cocktail of conventional detersive enzymes such as lipase, protease, and amylase. Detersive enzymes are described in greater detail in U.S. Pat. No. 6,579,839.

The liquid detergent compositions may optionally contain from 0.01 to 10% by weight of one or more soil release or soil suspension polymer that provide for broad-range soil cleaning of surfaces and fabrics and/or suspension of the soils. Useful polymers are described in US 2009/

0124528A1. Non-limiting examples of useful categories of soil release or soil suspending polymers include: amphiphilic alkoxylated grease cleaning polymers; clay soil cleaning polymers; soil release polymers; and soil suspending polymers.

If the viscosity of the liquid detergent composition is too high, then penetration of the composition into the fabric is less effective. If the viscosity is too low, the liquid detergent compositions may either pass straight through the fabric before it can be spread by the pretreatment cup, or is difficult to spread in a controlled manner. Therefore the liquid laundry detergent composition preferably has a flow viscosity, $V_f$, of from 10 cps to 2,000 cps, more preferable from 100 cps to 1,500 cps, most preferably from 200 cps to 700 cps, as measured at 20 $s^{-1}$ and 21° C., and a low shear rate neat viscosity, $V_1$, of from 100 cps to 100,000 cps, more preferably from 1,000 cps to 30,000 cps, most preferably from 2000 cps to 15,000 cps, as measured at 0.5 $s^{-1}$ and 21° C. Such a viscosity profile results in more effective spreading of the liquid laundry detergent composition over the stain.

Method of Laundering Fabrics:

The pretreatment cup (10) of the present invention is suitable for pretreating a variety of stains, and is particularly useful for improving the removal of greasy stains, grassy stains, particulate stains, and combinations thereof. Greasy stains comprise oils and fats. Grassy stains are those derived from contact with grass. Particulate stains comprise discrete particulate material. Particulate material, comprised in such stains, can include carbon residues from burnt food stuffs, and powders from such sources as make-up and soils.

A method of laundering fabrics, according to the present invention, comprises the steps of:

a. applying a portion of a liquid detergent composition to the fabric, to form a treated portion of the fabric;
b. scrubbing the treated portion of the fabric with the scrubbing region (110) of the pretreatment cup (10) according to the present invention; and
c. washing the fabric in a laundry washing machine, For durable fabrics, in step b, the treated portion of the fabric is preferably scrubbed with the pretreatment cup, in a direction that is substantially parallel to the elongated protrusions (120). When scrubbing in a direction which is substantially parallel to the major axis of the elongated protrusions (120), the scrubbing force is applied over a smaller cross section. As such, greater pressure is applied during scrubbing of the durable fabrics, resulting in more effective stain removal.

Durable fabrics have improved resistance to wear. As such, they are able to resist intense scrubbing during pretreatment, while retaining their shape, dimensional stability, and appearance. Durability encompasses such properties as abrasion resistance, tensile strength, and resiliency, and largely depends on the fibre content and fabric construction. Tensile strength is a prime quality in fibres used to make durable fabrics. Abrasion resistance, or the ability of a fibre to resist wearing away by friction or rubbing, is another important aspect of durability. As is resiliency, which is the ability of a fibre or fabric to hold its shape, and spring back when crushed or wrinkled. As such, durable fabrics comprise fibres with high tensile strength and good abrasion resistance. As such, durable fabrics typically comprise such materials as nylon, polyester, polypropylene, aramid, and combinations thereof. So not surprisingly, the most popular fibres currently for use in durable fabrics, in particular, durable knitted fabrics, comprise polyester, nylon, polypropylene, and combinations thereof.

In general, filament yarns, long-staple yarns, and combinations thereof, produce stronger, smoother, durable fabrics. The construction of the fabric can also impact the durability of a fabric. One characteristic associated with knitted fabrics is that they may exhibit elongation tendencies, which may or may not be desirable. Many times, the quality of a knitted garment is based on its ability to maintain its shape, and minimize elongation. As such, durable fabrics are typically made up of plain and twill weaves, and are often used in garments, such as denim jeans, sportswear items, and school uniforms, where durability is a major concern. Some of the cutting-edge knitted fabric developments in the areas of durability are associated with the fabrics for military uses, and for protective clothing in industry. Examples include durable fabrics comprising aramid fibres, such as Nomex and Kevlar. In knits, the tightly knitted constructions, produced on fine gauge knitting machines, provide improved durability.

For delicate fabrics, in step b, the treated portion of the fabric is preferably scrubbed with the pretreatment cup, in a direction that is substantially perpendicular to the elongated protrusions (120). Such scrubbing is particularly suitable for delicate fabrics selected from the group consisting of: elastane, lycra, spandex, polyamide, viscose, rayon, acrylic, silk, and combinations thereof, more particularly for: viscose, rayon, silk, and combinations thereof. Delicate fabrics, typically comprise a more open wave pattern, comprise weaker fibres, having short staple yarns, a thinner fabric material, and combinations thereof.

Intense scrubbing of delicate fabrics, during pretreating, would lead to loss of shape, dimensional stability, and a poorer appearance. Damage to delicate fabrics is substantially reduced when scrubbing with the pretreatment cap, of the present invention, in a direction which is substantially perpendicular to the elongated protrusions (120). The force applied on the treated portion of the fabric, in a direction that is substantially perpendicular to the elongated protrusions (120), is reduced since the force is applied over the length of the elongated protrusions (120). In addition, when excessive force is applied, the force applied to the fabric is limited by the protrusions (120) flexing or buckling under the applied load. Moreover, the liquid detergent composition provides greater lubrication during scrubbing in a direction which is substantially perpendicular to the elongated protrusions (120), which further reduces damage to delicate fabrics.

Stains are particularly hard to remove during cold water washing, such as is often required for delicate fabrics. Therefore, the methods disclosed herein, are particularly suitable for improving stain removal, wherein the fabrics are washed in a laundry washing machine at temperatures from 5° C. to 30° C., more preferably at room temperature (from 10° C. to 20° C.).

Methods:

A) Transparency/Translucency Measurements:

The translucency of a material is measured using the following procedure, using an X-Rite SP-64 Spectrophotometer:

1) Cut out a piece of a relatively flat portion of the bottle. The piece must be able to fit into the base calibration portion (also known as the 'shoe' of the X-Rite SP-64 Spectrophotometer. Clean the sample with a lint free cloth, taking care not to scratch the surfaces.
2) Calibrate the X-Rite SP-64 Spectrophotometer, using the "White reference" and "Black reference", following the procedure in the manual.

3) Select the "Opacity" option from the menu of the X-Rite SP-64 Spectrophotometer, and measure the opacity of the sample, using the "8 mm" aperture size: following the relevant procedure in the instruction manual, take a reading over the Black spot on the shoe, and then a reading over the White spot on the shoe. Repeat the measurement twice, and average the three readings to give the "% opacity".

4) The % translucency is calculated as: 100—% opacity.

B) Viscosity Measurements:

The viscosity of fluid detergents herein, namely $V_n$, and $V_d$, is measured using a TA AR550 Rheometer, manufactured by TA Instruments Ltd. The software used is provided with the instrument and called "Rheology Advantage Instrument Control AR".

The instrument is set up before each measurement according to the instructions reported in the Manual "AR550 Rheometer Instrument and accessory manual" (January 2004, PN500034.001 rev F) p 25-29, 40-44, and the Manual "Rheology advantage Instrument Control Getting Started Guide" (January 2004, Revision E) p 9-14, 20, 25-28, 37-38. The settings and parameters used are described herein.

In the "Geometry" section of the software (see Rheology advantage Instrument Control Getting Started Guide" (January 2004, Revision E) p 9), the gap between the rotating plate (40 mm steel plate) and the sample platform (Peltier plate) is set at 500 microns. The procedure is a continuous ramp test, i.e. a procedure in which the rheology of the sample is measured versus increasing shear rate. The setting for the shear rate ranges from 0.04 $s^{-1}$ to 30 $s^{-1}$ with a total duration of 3 minutes for the continuous ramp test, and sampling of 20 points per each tenfold increase in shear rate (automatically done), providing in total 60 measurements. The measurements are made at a temperature of 21° C.

A 5 ml sample of the liquid laundry detergent composition to be tested is loaded into the rheometer using a loading procedure as described herein. The sample loading procedure (as described in detail in the manual) is as follows:

1. The measurement temperature is set to 21° C. (see "instrument status" section), using the procedure outlined in the instruction manual.
2. The sample is loaded using a plastic pipette with a minimum diameter of 4 mm at the tip (to minimize the impact of the stress carried out by the loading action on the rheology of the sample). A 5 ml sample is applied to the center of the peltier plate, to assure full product coverage of the rotating plate.
3. The rotating plate (plate connected to the measuring system) is brought to the set distance (as defined above).
4. The excess of sample (i.e. any sample that may be around the edges of the rotating plate) is removed with a spatula assuring correct loading of the sample according to the description in the manual.

The measurement steps are as follows:

5. After the sample is loaded, it needs to be left for 10 seconds at rest. The run is started, while making sure the equipment is not exposed to vibrations during the measurement, as this will affect the results. In the case that the measurement is influenced by vibrations, the experiment is repeated whilst excluding the source of vibration.
6. At the end of the run the program stops automatically. All viscosity data are automatically saved.
7. The plates are cleaned with water and ethanol and then dried with paper towel.

EXAMPLES

Example 1

A Liquid Laundry Detergent Composition that is Suitable for Use in Combination with the Pretreatment Cup of the Present Invention

| Wt % | Example. 1 |
|---|---|
| C12-14 alkyl polyethoxylate (3.0) sulfate | 1.2 |
| C11.8 linear alkylbenzene sulfonc acid | 10 |
| C14-15 alkyl 7-ethoxylate | 6 |
| C12-14 alkyl 7-ethoxylate | 1 |
| Citric Acid | 3 |
| C12-18 Fatty Acid | 2.6 |
| Protease (54.5 mg/g/)[1] | 0.4 |
| Mannaway 25L (25 mg/g)[2] | 0.06 |
| Natalase 200L (29.26 mg/g)[2] | 0.09 |
| Whitezyme (20 mg/g)[2] | 0.06 |
| Termamyl Ultra (25.1 mg/g)[2] | 0.05 |
| Pectwash (20 mg/g) | 0.09 |
| Zwitterionic ethoxylated quaternized sulfated hexamethylene diamine[3] | 0.6 |
| Diethylene Triamine Penta Methylene Phosphonic acid | 0.4 |
| PEG-PVAc Polymer[4] | 1 |
| Grease Cleaning Alkoxylated Polyalkylenimine Polymer[5] | 0.2 |
| brightener | 0.1 |
| Hydrogenated Castor Oil | 0.4 |
| Ethanol | 1 |
| 1,2 propanediol | 4 |
| Na formate | 0.20 |
| $CaCl_2$ | 0.05 |
| mono ethanol amine | 0.5 |
| Na cumene sulphonate | 1 |
| C12-14 alkyl polyethoxylate (3.0) sulfate | 1.2 |
| C11.8 linear alkylbenzene sulphonic acid | 10 |
| C14-15 alkyl 7-ethoxylate | 6 |
| NaOH | Up to pH 8 |
| Water & minors | Up to 100% |

[1]Available from Genencor International, South San Francisco, CA.

[2]Available from Novozymes,, Denmark.

[3]Described in WO 01/05874 and available from BASF (Ludwigshafen, Germany)

[4]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. Available from BASF (Ludwigshafen, Germany).

[5]600 g/mol molecular weight polyethyleneimine core with 24 ethoxylate groups per —NH and 16 propoxylate groups per —NH. Available from BASF (Ludwigshafen, Germany).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

What is claimed is:

1. A pretreatment cup comprising:

a base comprising an exterior base surface;

a wall comprising an exterior wall surface; and an opening circumscribed by a rim, wherein the opening is at least partially opposite the base;

wherein the exterior base surface is connected to the exterior wall surface at an exterior periphery surface;

wherein a surface selected from the group consisting of: the exterior base surface, the exterior wall surface, the exterior periphery surface, and combinations thereof, comprises a scrubbing region, characterised in that the scrubbing region comprises at least two elongated protrusions, spaced apart by a distance between the elongated protrusions, the elongated protrusions having a length, width and height, wherein the length to width ratio is greater than 2, and the distance between the elongated protrusions is less than the height of the protrusions, at the position where the distance between the elongated protrusions is a minimum, wherein the pretreatment cup further comprises a spreading region, the spreading region comprising spreading protrusions which are oriented:

radially, concentrically, and combinations thereof, wherein the spreading protrusions are made from a material having a hardness, as measured on the Rockwell scale (ISO 2039-2), of from about 50 to about 150.

2. The pretreatment cup according to claim 1, wherein the spreading region is at least partially located on the exterior base surface.

3. The pretreatment cup according to claim 1, wherein the elongated protrusions are oriented substantially parallel to one another.

4. The pretreatment cup according to claim 1, wherein the elongated protrusions have a Shore A hardness of from about 1 to about 100, as measured using DIN53505.

5. The pretreatment cup according to claim 1, wherein the elongated protrusions are made of a material selected from the group consisting of: elastomers, rubbers, and mixtures thereof.

6. The pretreatment cup according to claim 1, wherein the elongated protrusions have a height from the exterior base surface of from about 0.2 mm to about 25 mm.

7. The pretreatment cup according to claim 1, wherein the elongated protrusions are separated by a distance of from 0.1 mm to 25 mm, as measured at a location in which the distance between the elongated protrusions is a minimum.

8. The pretreatment cup according to claim 1, wherein the elongated protrusions have a length of greater than 3 mm.

9. The pretreatment cup according to claim 1, wherein the scrubbing region is at least partially located at the exterior periphery surface.

10. The pretreatment cup according to claim 1, wherein:

a. the elongated protrusions are oriented substantially parallel to one another;

b. the elongated protrusions have a Shore A hardness of from about 1 to about 100, as measured using DIN53505;

c. the elongated protrusions have a height from the exterior base surface of from about 0.5 mm to about 10 mm;

d. the elongated protrusions are separated by a distance of about 0.2 mm to about 10 mm, as measured at a location in which the distance between the elongated protrusions is a minimum; and e. the length of the elongated protrusions is greater than about 3 mm.

11. The pretreatment cup according to claim 1, wherein the elongated protrusions have a height from the exterior base surface of from about 1 mm to about 5 mm.

12. The pretreatment cup according to claim 1, the elongated protrusions are separated by a distance of about 0.5 mm to about 1.5 mm, where the distance between the elongated protrusions is a minimum.

13. A pretreatment cup comprising:

a base comprising an exterior base surface;

a wall comprising an exterior wall surface; and an opening circumscribed by a rim, wherein the opening is at least partially opposite the base;

wherein the exterior base surface is connected to the exterior wall surface at an exterior periphery surface;

wherein a surface selected from the group consisting of: the exterior base surface, the exterior wall surface, the exterior periphery surface, and combinations thereof, comprises a scrubbing region, characterised in that the scrubbing region comprises at least two elongated protrusions, spaced apart by a distance between the elongated protrusions, the elongated protrusions having a length, width and height, wherein the length to width ratio is greater than 2, and the distance between the elongated protrusions is less than the height of the protrusions, at the position where the distance between the elongated protrusions is a minimum, wherein the pretreatment cup further comprises a spreading region, the spreading region comprising spreading protrusions which are oriented:

radially, concentrically, and combinations thereof, wherein the spreading protrusions are made from a material having a hardness, as measured on the Rockwell scale (ISO 2039-2), of from about 60 to about 100.

14. A pretreatment cup comprising:

a base comprising an exterior base surface;

a wall comprising an exterior wall surface; and an opening circumscribed by a rim, wherein the opening is at least partially opposite the base;

wherein the exterior base surface is connected to the exterior wall surface at an exterior periphery surface;

wherein a surface selected from the group consisting of: the exterior base surface, the exterior wall surface, the exterior periphery surface, and combinations thereof, comprises a scrubbing region, characterised in that the scrubbing region comprises at least two elongated protrusions, spaced apart by a distance between the elongated protrusions, the elongated protrusions having a length, width and height, wherein the length to width ratio is greater than 2, and the distance between the elongated protrusions is less than the height of the protrusions, at the position where the distance between the elongated protrusions is a minimum, wherein the pretreatment cup further comprises a spreading region, the spreading region comprising spreading protrusions which are oriented:

radially, concentrically, and combinations thereof, wherein the spreading protrusions are made from a material having a hardness, as measured on the Rockwell scale (ISO 2039-2), of from about 65 to about 85.

* * * * *